US005109183A

United States Patent [19]

Robertson et al.

[11] Patent Number: 5,109,183

[45] Date of Patent: Apr. 28, 1992

[54] HIGH PRESSURE DISCHARGE LAMP HAVING A SIMPLIFIED MOUNT CONSTRUCTION

[75] Inventors: Ronald T. Robertson, Addison; Kenneth E. Pearson, Canisteo, both of N.Y.

[73] Assignee: U.S. Philips Corporation, New York, N.Y.

[21] Appl. No.: 626,913

[22] Filed: Dec. 13, 1990

[51] Int. Cl.[5] ..... H01J 7/44; H01J 13/46; H01J 17/34

[52] U.S. Cl. ..... 315/58; 315/47; 315/71; 315/73; 315/74; 313/25; 313/573; 313/570; 313/634

[58] Field of Search ..... 315/58, 59, 60, 46, 315/47, 71, 73, 74, 75; 313/25, 634, 570, 573; 338/308, 293

[56] References Cited

U.S. PATENT DOCUMENTS

| | | | |
|---|---|---|---|
| 3,353,136 | 11/1967 | Umantsev | 338/308 |
| 3,947,799 | 3/1976 | Epaneshnikova et al. | 338/9 |
| 4,258,288 | 3/1981 | Michael et al. | 315/60 |
| 4,599,543 | 7/1986 | Strok | 315/73 |
| 4,792,782 | 12/1988 | Hammond | 338/309 |
| 4,901,051 | 2/1990 | Murata et al. | 338/308 |
| 5,008,583 | 4/1991 | Carleton | 315/73 |

FOREIGN PATENT DOCUMENTS

| | | |
|---|---|---|
| 56-73856 | 11/1979 | Japan . |
| 1211896 | 3/1988 | Japan . |

*Primary Examiner*—Eugene R. LaRoche
*Assistant Examiner*—Michael B. Shingleton
*Attorney, Agent, or Firm*—Brian J. Wieghaus

[57] ABSTRACT

A high pressure sodium discharge lamp having an arc tube mounted within a lamp envelope and having a resistor connected electrically in series with the arc tube. An insulative body is provided between the arc tube feed-through closest to the stem and a rigid conductor for axially supporting the arc tube and electrically insulating the feed-through from the rigid conductor. The series flicker-elimination resistor is mounted adjacent the lamp stem and electrically shunts the insulative body. An integral thick film resistor which includes the series resistor and a starting resistor for a starting circuit has optimized terminal placement for simplifying mount construction.

18 Claims, 3 Drawing Sheets

FIG. 1B
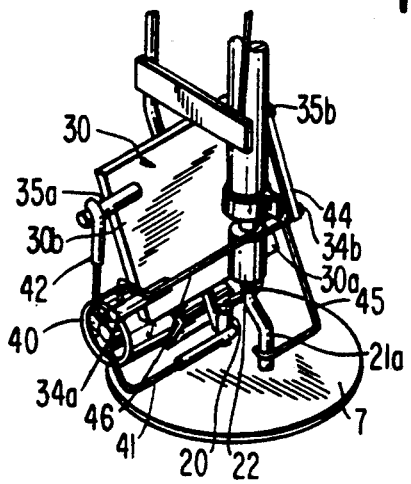
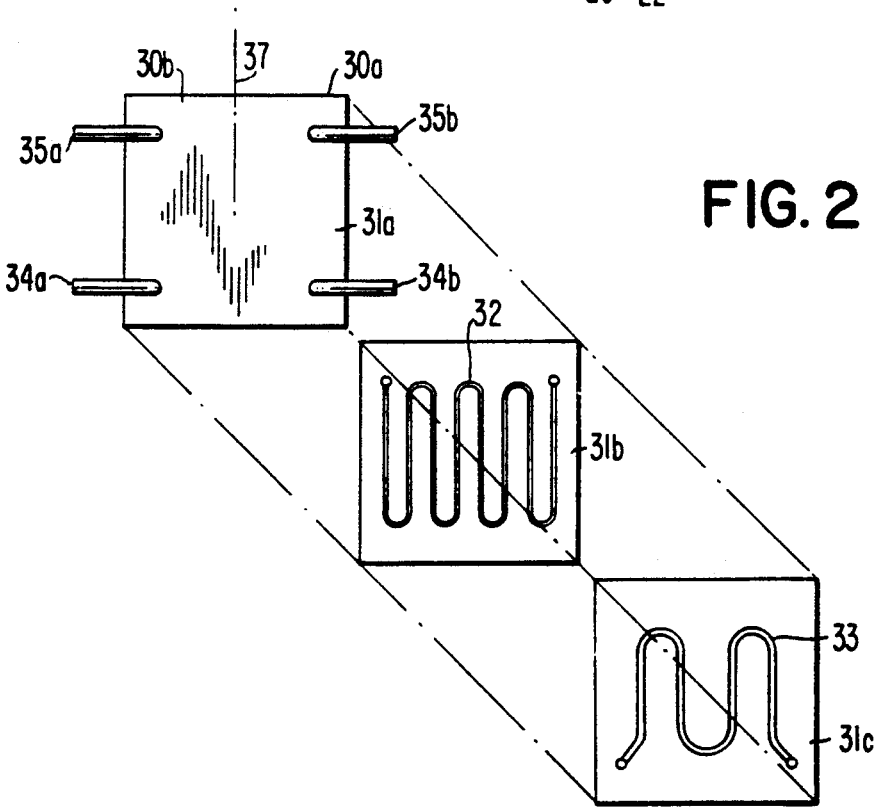
FIG. 2
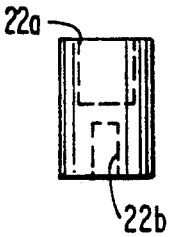
FIG. 3

HIGH PRESSURE DISCHARGE LAMP HAVING A SIMPLIFIED MOUNT CONSTRUCTION

CROSS-REFERENCE TO RELATED APPLICATIONS

The copending application Ser. No. 626,914 filed concurrently with this application entitled "High Pressure Discharge Lamp Having an Integral Thick Film Resistor with Multiple Resistive Elements" of Jagannathan Ravi discloses and claims a high pressure discharge lamp having a thick film resistor with multiple resistive elements disposed on integral substrate layers.

BACKGROUND OF THE INVENTION

1. Field of the Invention

The invention relates to high pressure discharge lamps, and more specifically, to high pressure discharge lamps having an electrical element in series with a discharge vessel and to the mount construction for mounting the discharge vessel within an outer envelope in such lamps. The invention also relates to a simplified arrangement for mounting the components of a starting circuit and a series resistor to the lamp frame.

2. Description of the Prior Art

High pressure sodium (HPS) discharge lamps typically have an elongate tubular ceramic discharge vessel, or arc tube, and a pair of conductive feed-throughs which extend through opposite ends of the arc tube and are connected to respective discharge electrodes within the arc tube. "Ceramic" as used herein means a crystalline oxide resistant to sodium, for example monocrystalline sapphire or polycrystalline densely-sintered aluminum oxide. A frame within an outer envelope supports the arc tube and applies an electric potential across the feed-throughs for energizing the arc tube to emit light. As known from U.S. Pat. Nos. 4,498,030; 4,328,445; 4,297,725; and 4,144,475, a desirable frame includes a rigid current-conductor extending from the lamp stem which supports and is electrically connected to the arc tube feed-through proximate the lamp stem. A second rigid current-conductor extends the length of the discharge vessel and supports and electrically connects the feed-through remote from the lamp stem. The above frames are desirable because they provide reliable support and electrical connection to the arc tube with a minimum number of parts.

For HPS lamps intended for operation on ballasts without a starter it is desirable to include a starting circuit within the envelope for starting the arc tube. A common starting circuit includes a glow starter in series with a current limiting resistor and a bimetal switch, all of which are electrically in parallel with the arc tube. The starting circuit generates a voltage, typically several kilovolts, sufficient for inducing ionization throughout the discharge vessel. Typically, the resistors used in HPS starting circuits dissipate greater than 100 watts during lamp starting, but are electrically disconnected from the lamp circuit by the glow starter upon ignition of the discharge arc. Within several minutes after ignition of the discharge arc, heat from the discharge vessel causes the bimetal switch to open and physically and electrically disconnect the glow starter and the starting resistor from the discharge vessel circuit.

Filament resistors have been used in starting circuits but have the disadvantage that they are generally long, and as a result are formed into coils and/or suspended in zig-zag form, causing space and mounting problems within the lamp envelope. More recently, ceramic thick film resistors, wherein a thick film resistive element such as tungsten is disposed on an insulative substrate, have also been used in starting circuits for HID lamps as is known from U.S. Pat. No. 5,008,583 (Carlet) and Japanese Kokai 56-73856.

HPS lamps, as with other discharge lamps, may have an electrical element in series with the arc tube and mounted within the outer envelope to alter or improve lamp performance. Recently, unsaturated HPS lamps have been used as retrofit lamps to replace mercury vapor lamps operated on constant-wattage type ballasts, for example, CWA ballasts. However, when operated on constant wattage ballasts, unsaturated HPS lamps of certain wattages may under certain conditions exhibit flicker of the discharge arc, especially for ballasts operating near or outside their rated specification. To eliminate flicker, it is known to provide a low ohmic value resistor in series with the unsaturated arc tube. Japanese Kokai 1-211896 shows an unsaturated HPS lamp having a series resistor which reduces the reignition arc voltage of the arc tube to prevent flicker of the arc. However, in JP Kokai 1-211896, the series resistor is a filament resistor mounted the lamp frame at the dome end of the lamp and connected to the lead-through remote from the lamp stem. This position is undesirable because it causes shadowing of light emitted from the discharge vessel and also requires a complex construction. U.S. Pat. No. 4,258,288 (Michael et al) shows a resistor in series with a metal halide arc tube which series resistor is also connected to the lead-through remote from the lamp stem and mounted at the dome end of the lamp envelope.

It would be desirable to mount the series resistor adjacent the reentrant stem of an unsaturated HPS lamp which also includes a starting circuit within the lamp envelope for operation on a CWA ballast. However, mounting of the starting resistor, glow starter, and bimetal switch near the base end of the lamp envelope is space consuming and typically requires multiple welds to the lamp frame. Mounting of an additional resistor component on the lamp frame between the discharge vessel and the lamp stem has not been practicable. For mercury-retrofit HPS lamps, the light center length of the arc tube measured from the base should equal the light center length of the mercury vapor lamp which it replaces to obtain optimum optical performance in the luminaire. Thus, it is not feasible to position the arc tube further from the base to obtain more mounting space on the lamp frame.

The above mentioned copending application to J. Ravi claims a thick film resistor which includes a starting resistor and a flicker elimination series resistor on an integral substrate. The use of such a combination resistor alleviates some of the space problems associated with mounting multiple components on the lamp frame adjacent the lamps stem. However, since in the desirable mount construction discussed above the shorter current-conductor provides electrical connection to the feed-through proximate the base, a series resistor cannot be connected between the shorter current-conductor and the feed-through with such a mount.

Accordingly, it is an object of the invention to provide an improved mount construction for a high pressure discharge lamp having an electrical element in series with the discharge vessel to lower the cost and increase the reliability of the lamp.

Another object of the invention is to provide a mount construction which facilitates the mounting of a series resistor substantially axially between the discharge vessel and the lamp stem along with the components of a starting circuit.

Yet another object of the invention is to provide an improved mount construction for a high pressure sodium discharge lamp which facilitates the electrical connection of a series resistor and the components of a starting circuit.

SUMMARY OF THE INVENTION

A high pressure discharge lamp according to the invention includes a discharge vessel enclosed in an outer envelope having a sealed end. The discharge vessel has a pair of conductive feed-throughs extending through respective ends of the discharge vessel for receiving thereacross an electric potential to energize the discharge vessel to emit light. Mounting means comprised of current-conductors within the envelope support the discharge vessel with a first feed-through proximate the sealed end of the lamp envelope. The mounting means further comprises insulative support means for electrically insulating the first feed-through from the current-conductors and axially supporting the end of the discharge vessel proximate the envelope sealed end. An electrical element is electrically in series with the discharge vessel and is physically connected between one of the current-conductors and the first feed-through and is mounted proximate the sealed end of the envelope. The above arrangement has the advantage that since the first feed-through is insulated from the current-conductors by the insulative support means, the series electrical element may be mounted adjacent the sealed end and physically and electrically shunt the insulative support means.

In one embodiment, the insulative support means comprises a rigid support extending from a reentrant stem and connected to the first feed-through for axially supporting the discharge vessel. The rigid support may itself be non-conductive, but preferably is a rigid conductor of the type conventionally used as rigid current-conductors in high pressure discharge lamps. The conductive support is electrically isolated from the current-conductors by reason of being spaced in the glass reentrant stem from the current-conductors. This construction is suitable in higher wattage discharge lamps in which the reentrant stem is large enough to accommodate three rigid conductors.

In another embodiment, an insulative support body axially supports the discharge vessel at the first feed-through on the end of a rigid current-conductor and electrically insulates the first feed-through from the rigid current-conductor. According to a desirable embodiment, the insulative body has a bore therein for receiving the end of the first feed-through and/or rigid conductor. A simple and reliable construction is obtained when the first feed-through and the end of the rigid conductor are axially aligned and the insulative body has a pair of opposing and aligned bores, each for receiving a respective end of the first feed-through and rigid conductor.

According to the preferred embodiment, the lamp is a high pressure sodium discharge lamp having a starting means for generating a voltage across the discharge vessel for inducing ionization throughout the discharge vessel and a second resistor in series with the discharge vessel for preventing flicker of the discharge vessel when the lamp is operated on a constant wattage type ballast. An integral thick film resistor comprises the first and second resistors and is mounted between the first current-conductor and a second rigid current-conductor, which extends the length of the discharge vessel and is connected to the second feed-through. The integral resistor is mounted substantially axially between the first feed-through and the lamp stem.

BRIEF DESCRIPTION OF THE DRAWINGS

FIG. 1*b* shows an enlarged perspective view of the support and starting circuit assembly of the lamp of FIG. 1*a;*

FIG. 2 shows an exploded view of the integral thick film combination resistor;

FIG. 3 shows an enlarged view of the insulative body;

DESCRIPTION OF THE PREFERRED EMBODIMENTS

Figure 1A:
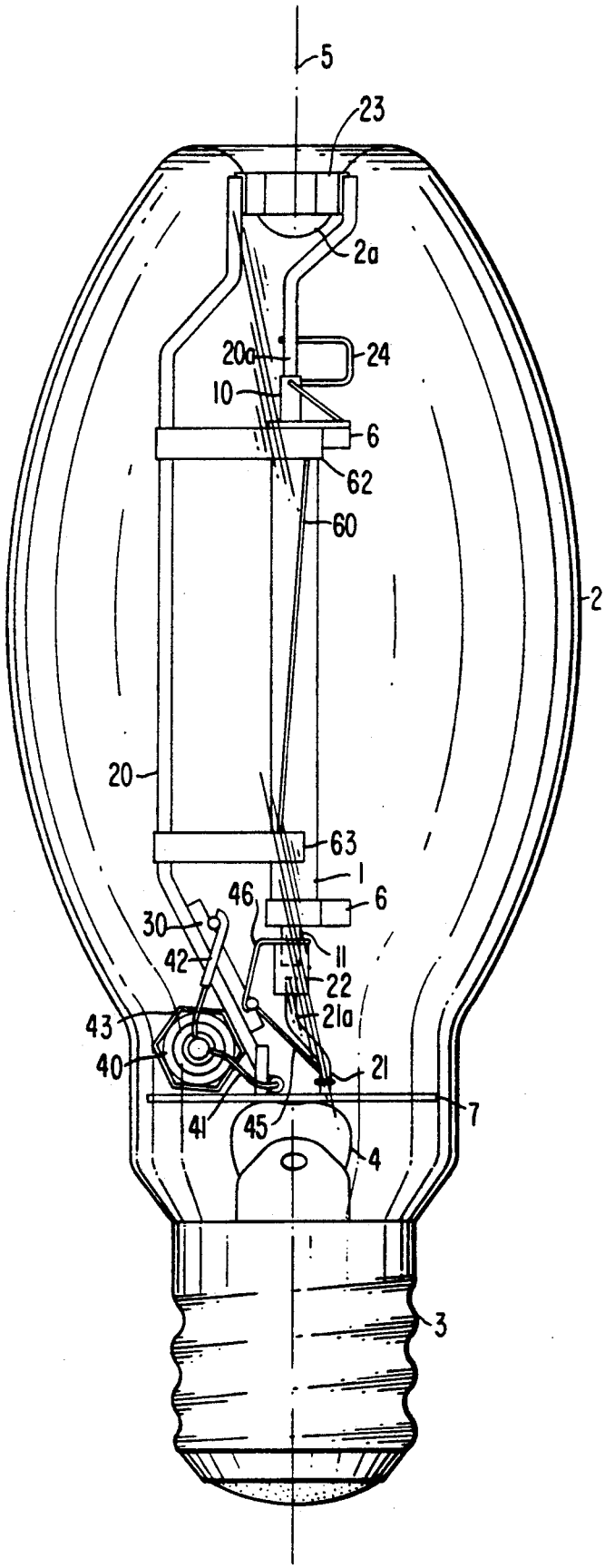
FIG. 1*a* illustrates a high pressure sodium vapor discharge lamp according to the invention having an insulative body disposed between a rigid current-conductor and an arc tube feed-through for supporting the arc tube.

The lamp shown in FIG. 1 is a 150 watt high pressure sodium (HPS) discharge lamp comprised of an elongate tubular discharge vessel, or arc tube, 1 of the unsaturated type disposed within an evacuated outer glass lamp envelope 2 and having a lamp base 3 at one end of the outer envelope 2. A quantity of sodium-mercury amalgam is contained within the discharge vessel 1, together with an inert buffer gas such as xenon, such that all of the amalgam is evaporated during normal lamp operation. The outer envelope is sealed in a conventional manner by reentrant stem 4. A conventional heat deflector 7 protects the glow switch 40 from excessive heating during sealing of the stem 4 to the outer envelope 2. The discharge vessel has a pair of conductive tubular feed-throughs 10, 11 of niobium for applying an electrical potential to a pair of discharge electrodes within the discharge vessel. Conventional metallic heat shields 6 surround the discharge electrodes adjacent the ends of the discharge vessel 1.

Mounting means within the outer lamp envelope support the discharge vessel aligned with the lamp axis 5 and with first feed-through 11 proximate the sealed end, or reentrant stem, 4 and the second feed-through 10 remote from the stem. The first feed-through 11 is axially supported by a short rigid current-conductor 21, which has an end 21*a* proximately spaced from feed-through 11, and insulative support means consisting of insulative support body 22. The insulative body 22 is circular-cylindrical and has opposing and aligned bores 22*a*, 22*b* for receiving the end 21*a* of support rod 21 and feed-through 11, to support the arc tube and electrically insulate feed-through 11 from current-conductor 21 (FIG. 3). The second feed-through 10 is supported by rigid current-conductor 20 which is formed from a single length of wire and is welded to spring clip 23, which holds a discontinuity or dimple 2*a* of the outer envelope. The end 20*a* of conductor 20 is conventionally inserted into the tubular feed-through 10 and electrically connected by conductive clip 24 welded to the feed-through 10 and conductor end 20*a*.

The insulative body 22 may be of any material, such as glass or ceramic, having the required strength and heat resistance and which does not outgas at the operating temperatures of the lamp. The alignment of the feed-through 11, end 21*a*, and bores 22*a*, 22*b* is preferred to simplify assembly and avoid bending moments on the body 22.

An integral ceramic thick-film resistor 30 is arranged between current-conductors 20, 21 adjacent the lamp stem. The resistor 30 has a first resistive element 32 included in a starting circuit for the discharge vessel and a second resistive element 33 connected in series with the discharge vessel 1. As shown in FIG. 2, the thick film resistor has 3 ceramic substrate layers 31*a*, 31*b*, and 31*c* of Alumina 90%. A first resistive element 32 consisting of a conventional deposited tungsten thick film pattern is disposed on the substrate layer 31*b* and a second resistive element 33 also of tungsten is disposed on substrate layer 31*c*. The first substrate layer 31*a* protects the first resistive element. Resistor terminals 34*a*, 34*b* on substrate 31*a* are connected to the second resistive element 33 and terminals 35*a*, 35*b* also on substrate 31*a* are connected to the first resistive element 32. Alternatively, the first and second resistive elements may be deposited on opposite sides of substrate 31*b*, the resistive elements being protected by outer layers 31*a*, 31*c* or by a protective coating applied over the resistive elements. The metallic deposition patterns 32, 33 are shown schematically in FIG. 2 because the patterns themselves are conventional and the number of patterns for any given resistance value which may be needed in an HID lamp are numerous, and depend for example on the desired size of the substrate. The resistor is secured between the conductors by an L-shaped conductive lead and support 45 which is welded to resistor terminal 34*b* and lead 21 (FIG. 1*b*).

Starting means for starting the discharge vessel is comprised of a starting circuit which consists of a conventional glow starter switch 40, having a pair of bimetallic electrodes therein, in series with the first resistive element 32 and a bimetal switch 44 which has one end welded to resistor terminal 34*b* and is normally closed against terminal 35*b*. The glow starter 40 is supported by a glow starter holder 43 welded to the rigid conductor 20. The starting circuit defines a first conductive path electrically in parallel with the discharge vessel 1. The starting circuit consists of a first lead 41 of the glow starter connected to the current-conductor 20, the glow starter, a second glow starter lead 42 connected to resistor terminal 35*a*, the first resistive element 32, the resistor terminal 35*b*, bimetal switch 44, terminal 34*b*, and lead-support 45 connected to rigid current-conductor 21.

A second conductive path extends from the current-conductor 21, through lead-support 45 to terminal 34*b* of the second resistive element, through the second resistive element 33, the other terminal 34*a*, conductive lead 46, and through feed-through 11 through the discharge vessel 1, through feed-through 10, connector 24 and current-conductor 20.

The lamp also has a starting aid for inducing ionization throughout the discharge vessel within the limits of the high voltage pulse of the starting circuit. The starting aid consists of conventional antenna 60 and bimetal elements 62 and 63 which are welded to the conductor 20. In the inoperative condition of the lamp, the bimetal elements 62, 63 hold the starting antenna against the wall of the discharge envelope.

The functioning of the starting aid and the starting circuit during ignition of the lamp are as follows. When connected to an inductive stabilization ballast of the constant wattage type, and the AC supply current is effected, a glow discharge will first be produced in the glow starter 40, which heats the bimetallic electrodes within such that the glow starter electrodes touch and extinguish the glow discharge. A current of high intensity will then flow through the ballast. During this time, the first resistive element 32 limits the current through the glow starter and heats the substrate and the second resistive element 33. Upon cooling, the glow starter electrodes will separate, interrupting the current through the ballast, and causing a high voltage peak across the discharge electrodes of the discharge vessel 1. Simultaneously, a high voltage potential will also be applied between the starting antenna 60, via the bimetal elements 62, 63 and conductor 20, and the discharge electrode adjacent the feed-through 11. This causes substantial ionization of the buffer gas throughout the discharge vessel, and starting of the discharge due to the large potential difference between the discharge electrodes. At this time, lamp current flows through heated second resistive element and the second conductive path described above.

After ignition of the discharge arc, the voltage between the discharge electrodes will be below the glow voltage value of the glow starter electrodes and the glow starter will remain extinguished. Within several minutes after ignition of the discharge arc, heat from the discharge vessel 1 causes the bimetal switch 44 to open and physically and electrically disconnect the glow starter 40 and the first resistive element 32 from conductor 21 so that the glow starter and first resistive element are no longer connected electrically in parallel with the discharge vessel. Heat from the discharge vessel also causes the bimetals 62 and 63 to move the starting antenna 60 away from the discharge vessel.

The arrangement of the resistor terminals on the substrate is significant to the mounting and electrical interconnection of the first and second resistive elements of the combination resistor to the glow starter discharge vessel, and the current conductors. There are numerous possible arrangements for the location of the resistor terminals on the substrate and for support of the substrate in the base end of the lamp. The arrangement shown in FIG. 1*b* minimizes the number of lamp parts and simplifies assembly while improving reliability by optimizing routing of the interconnecting leads to prevent shorting.

The use of the lead-support 45 to electrically connect the first resistive element to the conductor 21 and to support the combination resistor eliminates a separate support and reduces the required number of welds. The connection of the lead-support 45 to a lower one of the resistor terminals prevents possible shorting of lead-support 45 with the two glow-starter leads and lead 46. In prior lamps having a thick film resistor comprising a starting resistor only, a dummy terminal on the resistor connected to a current-conductor was provided as a contact for the opening bimetal, as shown in JP 56-73856. In the combination resistor of FIG. 2, the use of terminal 34*b* of the series resistive element for a contact point of the bimetal eliminates the dummy terminal.

It is advantageous to position the glow starter on the conductor 20 and to use the resistor 30 to shield the glow starter from radiation from the discharge vessel. The location of the resistor 30 between the conductors 20 and 21 is necessitated by the position of the glow starter. The placement of the terminals 34*b*, 35*b* on one side of the plane through the conductor 20, 21 ensures that the bimetal 44 is oriented to avoid contact with the conductors 20, 21. The placement of the terminal 34*a* on a portion 30*b* of the resistor located on the other side of the plane through the conductors permits routing of the glow starter leads 42 to terminal 35*a* from conductor 20 without crossing conductor 20, and avoids shorting of lead 42 on conductor 20. Thus, the arrangement of the terminals 35*a*, 35*b* for the first resistive element (starting resistor) on opposite sides of conductor 20 and further from the lamp stem than the terminals for the second resistive element (series resistor) facilitates mounting of the combination resistor, and glow starter to the lamp frame.

Figure 4:
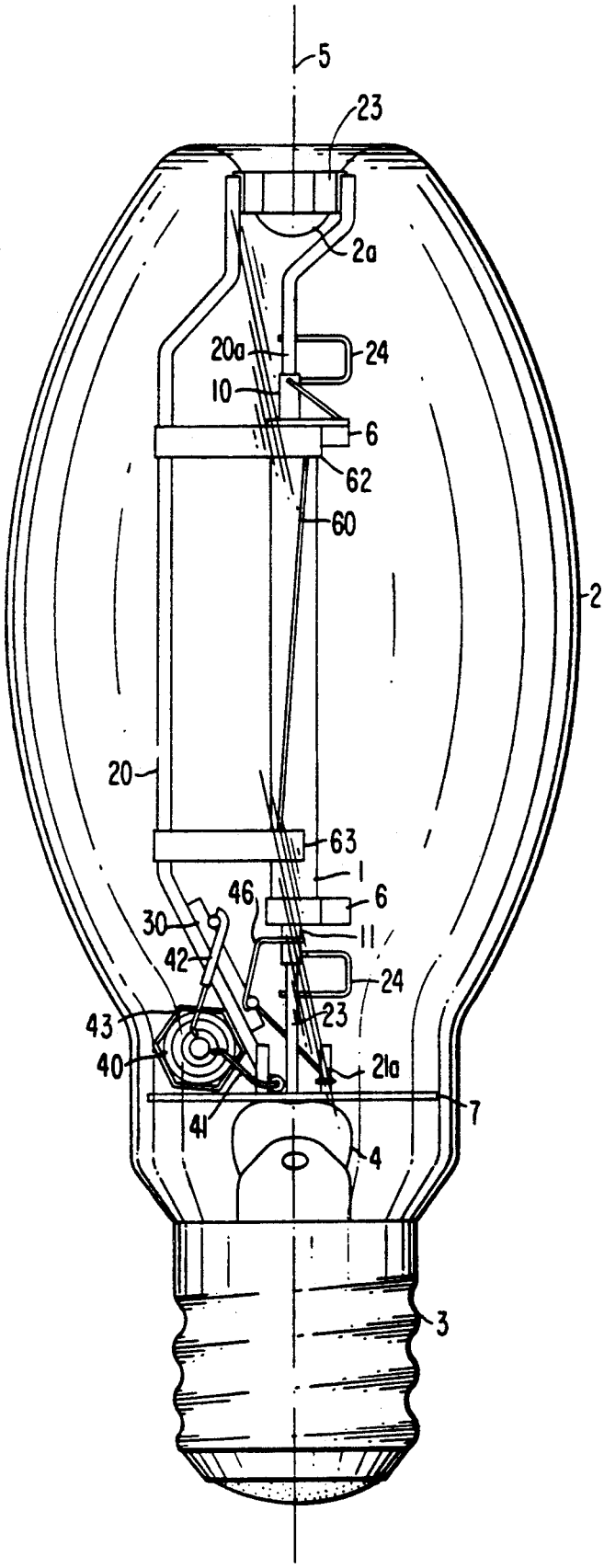
FIG. 4 shows another embodiment of the invention having a 3-lead stem, one of the leads being electrically insulated from the current-conducting leads and extending from the lamp stem for supporting the arc tube.

FIG. 4 shows an HPS lamp having an alternative embodiment for the insulative support means. Lamp parts corresponding to those in FIG. 1 have the same reference numbers. Instead of an insulative support body, the lamp of FIG. 3 has a 3-lead stem assembly consisting of a rigid support rod 23 in addition to the current-conductors 20 and 21. The support rod 23 extends from the stem press and has its end inserted in tubular niobium feed-through 11 to support the end of the discharge tube nearest the stem. The support rod 23 in the lamp of FIG. 3 is nickel-plated iron wire, which is conventionally used for the current-conductors 20, 21. This construction has the advantage that the formation of a 3-lead stem may be readily automated. The lead 21 is connected to the terminal 34*b* of resistor 30 by support-lead 45 as shown in FIG. 1*b*. The operation of the lamp is identical to that of the lamp shown in FIG. 1, as described above.

While there has been shown to be what are presently considered to be the preferred embodiments of the invention, it will be apparent to those of ordinary skill in the art that modifications can be made without departing from the scope of the invention as defined by the appended claims. For example, the insulative body 22 may have a portion which is insertable into the end of the feed-through 11 instead of bore 22*a*. Alternatively, the insulative body may have metallic tabs which are welded to the feed-through 11 and conductor 21*a*.

We claim:

1. In a high pressure discharge lamp comprising an outer envelope with a sealed end, a discharge vessel energizable for emitting light and having a pair of feed-throughs extending through respective ends of said discharge vessel, mounting means comprising current-conductors within said envelope for mounting said discharge vessel with a first said feed-through proximate said envelope sealed end, and an electrical element connected electrically in series with said discharge vessel during lamp operation, characterized in that:

said mounting means further comprises insulative support means for electrically insulating said first feed-through from said current-conductors and axially supporting the end of said discharge vessel proximate said sealed end; and said electrical element being electrically connected between one of said current-conductors and said first feed-through and mounted adjacent said sealed end.

2. In a high pressure discharge lamp according to claim 1, wherein said insulative support means comprises a rigid support rod extending from said sealed envelope end, said rigid support rod being electrically isolated from said conductors and connected to said first feed-through for supporting said discharge vessel.

3. In a high pressure discharge lamp according to claim 2, wherein said electric element is a resistive element.

4. In a high pressure discharge lamp according to claim 1, wherein a said current-conductor is rigid and has an end proximately spaced from an end of said first feed-through, and said insulative support means comprises an insulative body disposed between said spaced ends.

5. In a high pressure discharge lamp according to claim 4, wherein said spaced ends of said rigid current-conductor and said first feed-through are aligned and said insulative body comprises a bore for receiving a said spaced end.

6. In a high pressure discharge lamp according to claim 5, wherein said insulative body has a pair of opposing and aligned bores for receiving said aligned and spaced ends of said first feed-through and rigid current-conductor.

7. In a high pressure discharge lamp according to claim 6, wherein said electric element is a resistive element.

8. In a high pressure sodium discharge lamp comprising a) an outer envelope having a reentrant stem sealing and end of said envelope in a gas-tight manner;

b) an elongate high pressure sodium discharge vessel having a pair of feed-throughs each extending through a respective end of said discharge vessel for receiving thereacross an electric potential to energize said discharge vessel to emit light;

c) mounting means within said envelope for mounting said discharge vessel with a first said feed-through proximate said envelope sealed end and the second said feed-through remote from said sealed end, said mounting means comprising first and second rigid current-conductors; and d) a resistive element connected electrically in series with said discharge vessel, characterized in that:

said mounting means further comprises insulative support means for axially supporting said discharge vessel at said first feed-through and electrically insulating said first feed-through from said current-conductors, and said resistive element being electrically connected between one of said current-conductors and said first feed-through and mounted proximate said sealed end.

9. In a high pressure sodium discharge lamp according to claim 8, wherein said insulative support means comprises a rigid support extending from said stem and connected to said first feed-through for supporting said discharge vessel, said rigid support being electrically insulated from said first and second current-conductors.

10. In a high pressure sodium discharge lamp according to claim 9, wherein said rigid support is a rigid conductive lead.

11. In a high pressure sodium discharge lamp according to claim 8, wherein a said first rigid current-conductor terminates adjacent said first feed-through, said insulative support means comprises an insulative body disposed between said first rigid current-conductor and said first feed-through for supporting said discharge vessel on said first rigid conductor and insulating said first feed-through from said first rigid conductor, and said resistive element is electrically connected between said first rigid current-conductor and said first feed-through, whereby said resistive element electrically shunts said insulative body.

12. In a high pressure sodium discharge lamp according to claim 11, wherein said first feed-through and said first rigid current-conductor have opposing ends proximately spaced from each other, and said insulative body comprises a bore for receiving a said opposing end of one of said first rigid current-conductor and said first feed-through.

13. In a high pressure sodium discharge lamp according to claim 12, wherein said opposing ends of said first feed-through and said first rigid current-conductor are aligned, and said insulative body comprises a pair of opposing and aligned bores for receiving said aligned and opposing ends of said first feed-through and said first rigid current-conductor.

14. In a high pressure sodium discharge lamp according to claim 13, wherein said second rigid current-conductor extends the length of said discharge vessel, and a thick film resistor secured to a said current-conductor proximate said sealed end comprises said resistive element.

15. A high pressure sodium discharge lamp, comprising:

a) an outer envelope defining a lamp axis and having a reentrant stem sealing end of said envelope in a gas-tight manner;

b) an elongate high pressure sodium discharge vessel having a pair of feed-throughs each extending through a respective end of said discharge vessel for receiving thereacross an electric potential to energize said discharge vessel to emit light;

c) mounting means within said envelope for mounting said discharge vessel aligned with said lamp axis with a first said feed-through proximate said envelope sealed end and said second feed-through remote from said sealed end, said mounting means comprising first and second rigid current-conductors axially extending from second reentrant stem, said first current-conductor having an end proximately spaced from and aligned with said first feed-through, said second current-conductor extending the length of said discharge vessel and connected to said second feed-through, and an insulative body disposed between said first feed-through and said end of said first current-conductor for axially supporting said discharge vessel and electrically insulating said first feed-through from said first current-conductor;

d) starting means within said lamp envelope for generating a voltage across said feed-throughs for inducing ionization throughout said discharge vessel, said starting means comprising a starter resistive element; and e) an integral thick film resistor comprising said starter resistive element and a series resistive element, said series resistive element being electrically connected in series with said discharge vessel, said integral resistor being arranged substantially axially between said first discharge vessel feed-through and said reentrant stem, and said series resistive element being electrically connected to said first current-conductor and said first feed-through, electrically shunting said insulative body.

16. A high pressure sodium discharge lamp according to claim 15, wherein said starting means further comprises a glow starter switch and a bimetal switch electrically in series with said starter resistive element, said starter resistive element, glow starter switch, and bimetal switch being electrically in parallel with said discharge vessel;

said integral thick film resistor being planar and having one portion disposed on one side of a plane through said current conductors and an other portion on the other side of the plane through said current conductors, said resistor having a pair of terminals for each resistive element, a first terminal of each resistive element being disposed on said one resistor portion with said first terminal of said series resistive element disposed closer to said stem than said first terminal of said starter resistive element, said bimetal switch being arranged across said first terminals, and said first terminal of said series resistive element being electrically connected to said first current-conductor.

17. A high pressure sodium discharge lamp according to claim 16, wherein a conductive support lead connected between said first current-conductor and said first terminal of said series resistive element supports said integral thick film resistor.

18. A high pressure sodium discharge lamp according to claim 17, wherein said thick film integral resistor is disposed between said first and second current-conductors, said glow starter switch being fixed to said second-current conductor opposite said thick film resistor, a second terminal of said starter resistive element being disposed on the other said resistor portion on said other side of said plane through said current-conductors, and said glow starter switch having a pair of starter leads connected to said second current-conductor and said second terminal of said starter resistive element.

* * * * *